United States Patent [19]

Trunk

[11] Patent Number: 4,914,427

[45] Date of Patent: Apr. 3, 1990

[54] MATRIX DISPLAY SYSTEM AND METHOD

[75] Inventor: Edmund G. Trunk, East Meadow, N.Y.

[73] Assignee: The Staver Company Inc., Bay Shore, N.Y.

[21] Appl. No.: 266,938

[22] Filed: Nov. 3, 1988

[51] Int. Cl.[4] ..... G09F 9/37; G09F 13/34

[52] U.S. Cl. ..... 340/764; 340/783; 40/449; 40/452

[58] Field of Search ..... 340/764, 763, 783; 40/449, 451, 450, 452, 583, 582, 463, 447

[56] References Cited

U.S. PATENT DOCUMENTS

| | | | |
|---|---|---|---|
| 3,680,083 | 7/1972 | Pihl | 340/764 |
| 4,069,480 | 1/1978 | Helwig | 340/768 |
| 4,161,832 | 7/1979 | Bergamini | 340/764 |
| 4,163,332 | 8/1979 | Salam | 340/783 |
| 4,295,127 | 10/1981 | Sautter et al. | 340/764 |

*Primary Examiner*—Alvin Oberley
*Attorney, Agent, or Firm*—Edward H. Loveman

[57] ABSTRACT

This matrix system and method for displaying graphic characters has a vertical panel with openings arranged in a rectangular array. At each opening is a display disk rotatable 180° in a path between a non-reflective upright forward facing first position, and a light reflective upright forward facing second position. Each disk is turned on a horizontal axis and can be stopped in horizontal position midway in the path of disk rotation by an electromagnetically extensible and retractable stop member. The disks are turned by interaction between an electromagnetically energized magnetic core, and a permanent magnet rotatable with the disk. Lamps behind the disk can project back light through the openings when the disks are in midway positions to display graphic characters. Retraction of the stop members allows selected disks to turn to an upright light reflective position, to display graphic characters by ambient reflected light, while remaining disks provide a light blocking non-reflective background. At dusk all disks can be turned to upright non-reflective position while all stop members are extended to stop any selectively rotated disks in a horizontal position and while the back lights are turned on. At dawn, all stop members can be retracted, lights turned off, and disks in midway position turned to upright light reflective position to display graphic characters, only by reflected light.

8 Claims, 4 Drawing Sheets

MATRIX DISPLAY SYSTEM AND METHOD

BACKGROUND OF THE INVENTION

1. Field of Invention

This invention relates generally to changeable displays of graphic data by means of a multiplicity of pivotable disks movable between three positions for day and night viewing conditions; and more particularly, the invention involves a system and method employing a geometric or rectangular matrix of display disks in vertical columns and horizontal rows, selectively turnable to an upright front reflective position, an upright front non-reflective position, and a horizontal 90° position for transmitting back light.

2. Description of the Prior Art

It has been known heretofore to provide a disk display capable of assuming three disk positions. The matrix display system described in U.S. Pat. No. 4,380,879 which issued Apr. 26, 1983 to L. Seibert, is typical of the three-position disk display matrices heretofore known. Such prior systems have a particular significant deficiency in that there is no positive mechanical way of holding the disks in a horizontal, light passing position. The prior systems rely on magnetic attraction of two angularly spaced electromagnets, which arrangement is not wholly satisfactory to effect 90° horizontal positioning of the disks. Other objections pertain to the complex and expensive construction of the matrices; and the inability to insure that no disk can inadvertently turn to an upright forward light reflective position, when it is desired to turn the disk to a horizontal back lighting position.

SUMMARY OF THE INVENTION

According to the invention there is provided a rectangular matrix of rotatable display disks. Behind the disks is a multiplicity of electromagnets for actuating pins which project into the paths of rotation of the disks to serve as stop members. Initially, at dusk, for example, all disks are rotated to upright forward facing non-reflective position. Then the electromagnets are all actuated simultaneously to project individual pins into the path of rotation of each disk, and back light sources are energized behind the matrix. The system is thus primed so that when a selected number of disks are rotated for displaying characters by transmitted back light, the selected disk can only rotate 90° because they are stopped by the forward projecting pins or stop members. The back light will project beyond the horizontal disks to display the desired character by transmitted light. At dawn, all the forwardly projecting pins may be retracted simultaneously. The horizontal disks will automatically rotate to the upright forward facing light reflective position to continue the same display of characters, but by ambient reflected light. Alternately, the character display can then be changed by rotating certain disks to forward display position for viewing by ambient reflected light while turning all other disks to the upright nonreflective or background position. Since all of the electromagnets are actuated at the same time, they can be wired in parallel to each other, thereby reducing the number of wires from an electronic contol unit, and simplifing control circuits.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
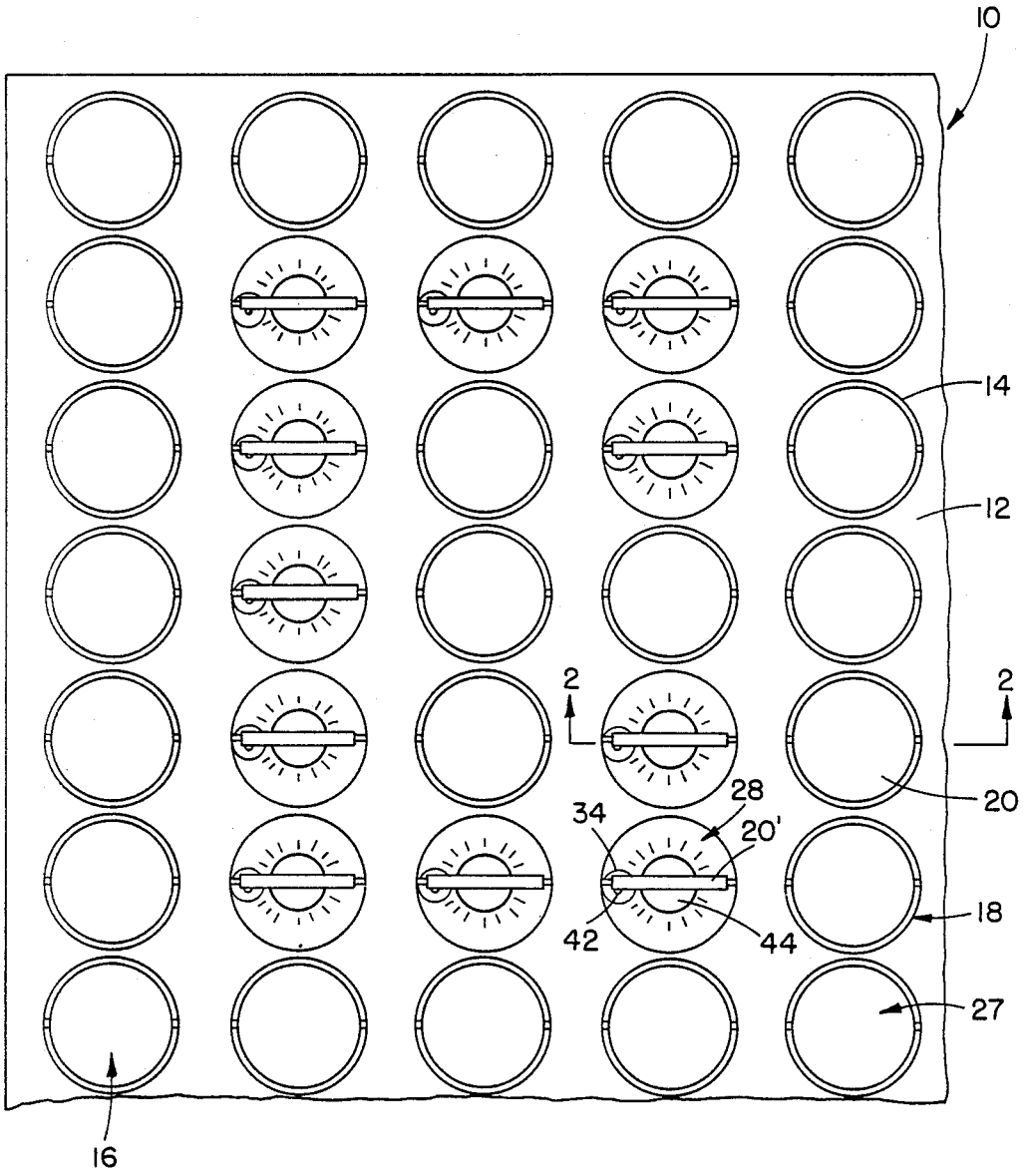
FIG. 1 is a front elevational view of a display matrix system embodying the invention.
Figure 2:
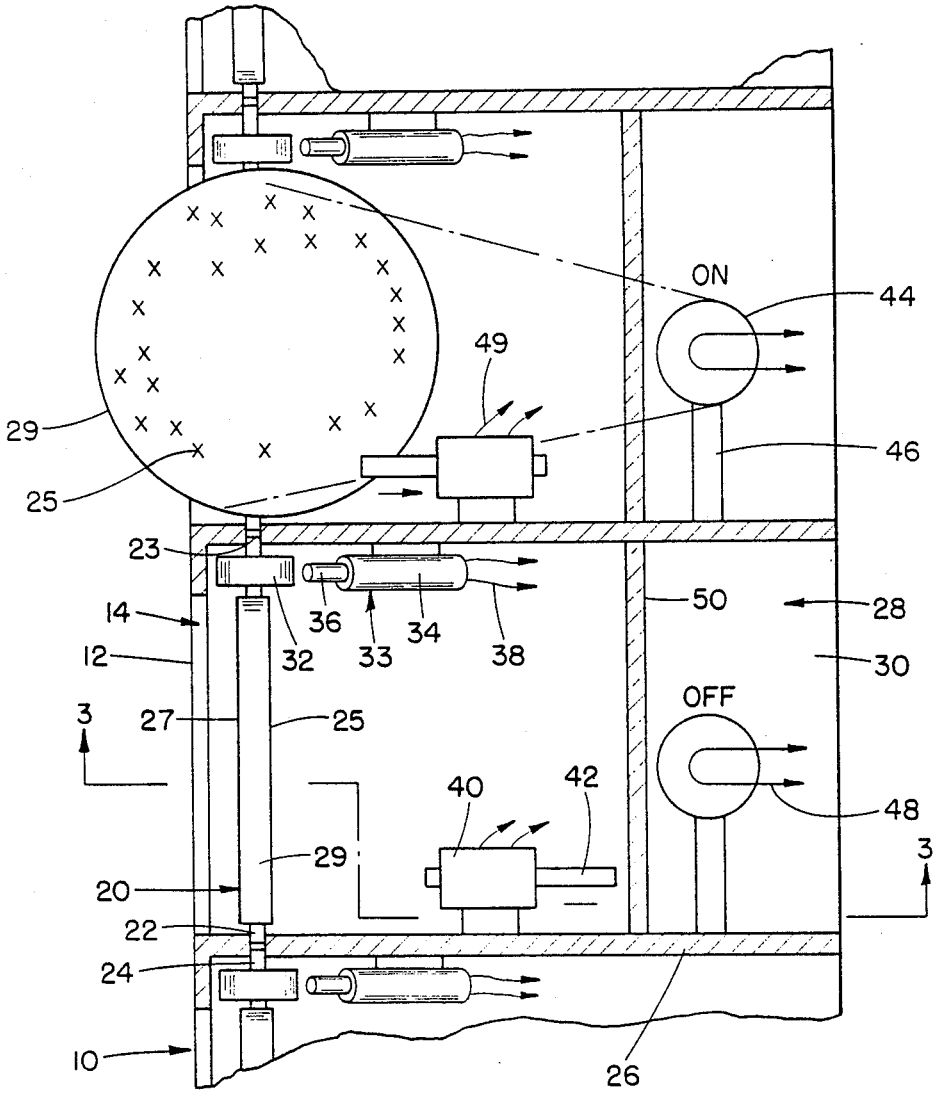
FIG. 2 is an enlarged fragmentary horizontal sectional view taken along line 2—2 of FIG. 1.

Referring now to the drawings wherein like reference characters designate like or corresponding parts throughout, there is illustrated in FIGS. 1 and 2 a disk display matrix, generally designated as reference numeral 10 which has a vertical background panel or mask 12, formed with a multiplicity of circular holes or openings 14, arranged in a rectangular array of parallel vertical columns 16 and horizontal parallel rows 18. The panel 12 is preferably coated with a matte black surface. Rotatably mounted in and slightly behind the openings 14 and substantially in peripheral registration therewith are circular display disks 20. As best shown in FIG. 2, pins or pin shafts 22, 23, extend outward in horizontal diametral alignment from opposite edges of each disk 20. The pins 22, 23, are engaged in respective holes 24 formed in horizontally spaced vertical side walls 26 extending rearwardly from the front panel 12. Each of a pair of side walls 26 and the rear side of the panel 12 define a rectangular compartment 28, open at the rear of the assembly, with vertically spaced horizontal partitions 30 attached to the vertical walls 26.

Figure 3:
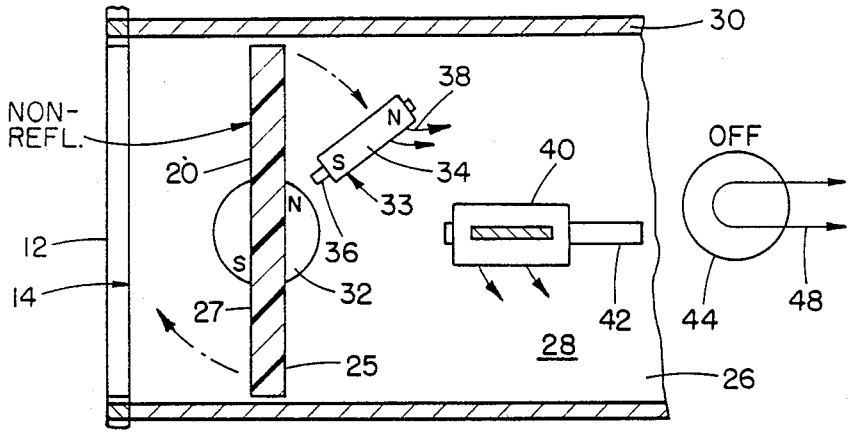
FIG. 3 is a horizontal sectional view, partially schematic in form, taken along line 3—3 of FIG. 1, showing a display disk in upright forward facing non-reflective position.
Figure 4:
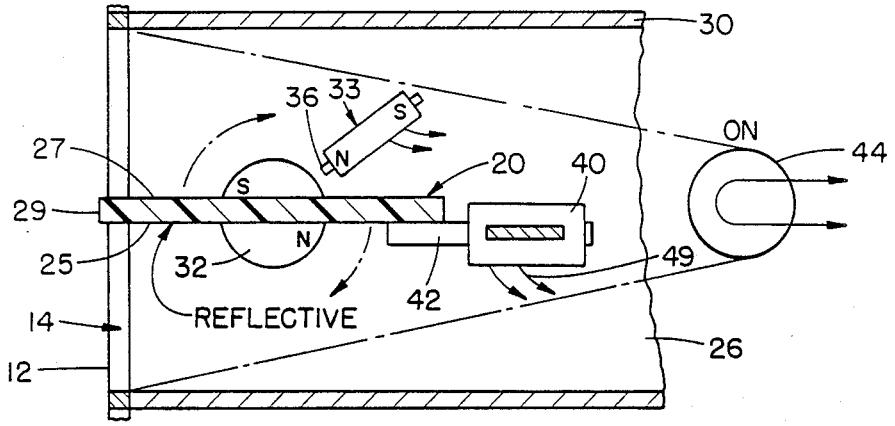
FIG. 4 and FIG. 5 are views similar to FIG. 3 respectively showing the display disk in horizontal 90° position and in an upright forward facing light reflecting position.
Figure 5:
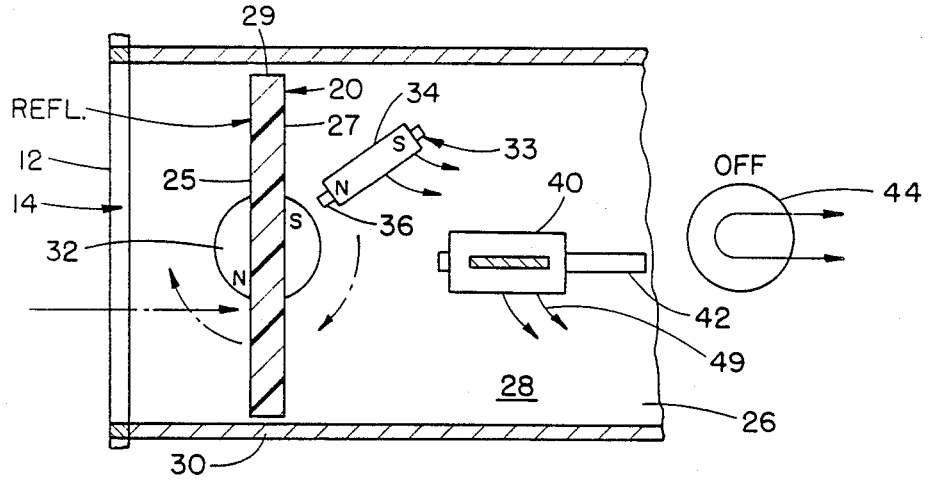

One face 25 of each of the disks 20 is colored white or yellow to maximize light reflectivity and will be hereinafter referred to as the daytime display face. The rear side 27 and the periphery 29 of each of the disks 20 is colored matte black or otherwise treated to minimize light reflectivity. At one edge of each disk 20, a circular disklike permanent magnet 32 is mounted to turn with the disk 20. As best shown in FIGS. 3–5 the disks 20 are permanently magnetized with spaced N and S poles. Behind each disk 20 and mounted on the adjacent side wall 26 is affixed an electromagnet 33 having a coil 34 which has a fixed core 36 adjacent to the periphery of one of the rotatable disk magnets 32. A pair of wires 38 extend from each of the coils 33 to an electrical energizing circuit (not shown) for the electromagnet 33 to alternately polarize the coil 36 with an N or S pole as indicated in FIGS. 3–5.

Each disk 20 is rotatable about 180° between the vertical forward facing front display position and the vertical forward facing front blank or non-reflective position. In order to stop rotation of each disk in a horizontal position there is provided a solenoid 40 mounted on a side wall 26 of each of the compartments 28. The solenoid 40 has an axial core 42 movable between a forwardly extended position, as shown in FIGS. 2 and 4, and a retracted position, shown in FIGS.

2, 3 and 5. When the core 42 is in the forward position it will extend into the path of rotation of the disk 20 to engage a rear edge portion of the disk 20 as shown in FIGS. 2, 4, and 5, and thus prevent the disk 20 from completing a full 180° range of rotation. The disk will be held in a 90° horizontal open position. Behind the disk 20 at the back end of each of the compartments 28 is a light source such as a lamp 44, mounted on a post or bracket 46 attached to the side wall 26 or to a horizontal wall or partition 30. When the lamp 44 is energized, and the solenoid 40 has extended the core 42 to hold the disk 20 in horizontal position, the forward end of the compartment 28 is open and can pass or transmit light forwardly of the panel 12, through the opening 14 to the display viewing position. The lamp 44 has wires 48 and the solenoids 40 have wires 49 which terminate in an external circuit (not shown).

FIG. 1 shows a plurality of selected disks 20′ disposed in horizontal 90° position and held there by the solenoid pins or cores 42. These particular selected horizontal disks 20 define a letter "C". The remainder of the disks 20 are disposed with their non-reflective sides 27 facing forwardly. The light source or lamp 44 is energized so that the viewer sees an illuminaed "C".

Figure 6:
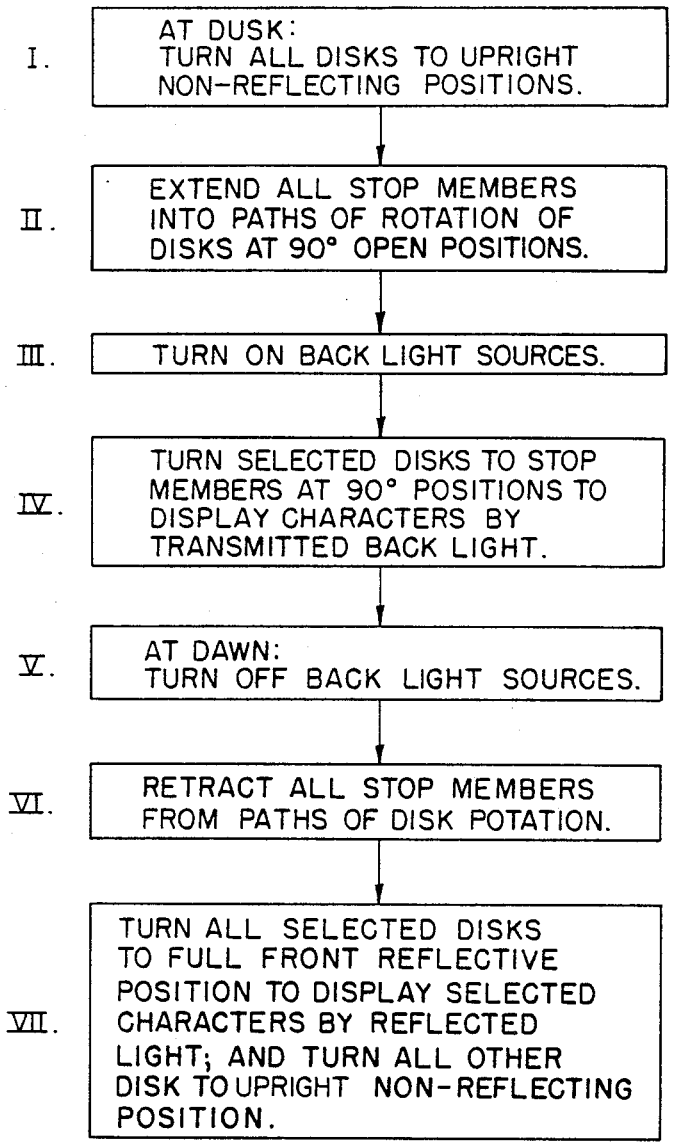
FIG. 6 is a flow chart diagram illustrating the display method according to the invention.

In operation of the display system, as summarized in FIG. 6, at dusk, or at sufficiently low ambient light levels all the electromagnets 33 are energized at step I, to position the non-reflective sides 27 of all of the disks 20 upright and facing forwardly. Then in step II the pins or cores 42 of the solenoids 40 are extended simultaneously into the paths of rotation of all the disks 20. At the same time, or at a later time in step III, all the back light sources or lamps 44 are energized. In step IV the selected disks 20′ are turned by the energizing electromagnets 33 so that the selected disks assume the horizontal, light transmitting position illustrated in FIGS. 1, 2, and 4, to display a desired graphic character only by the transmitted light. It is of course possible that some of the transmitted light will be reflected from the light reflecting side 25 of the horizontal disks 20. If they are visible, they will enhance the lighted display effect. In order to further enhance or diffuse the transmitted light display effect, translucent, transparent or diffusion sheets or plates 50 can be mounted in the compartment 28 in front of the light sources 44 as shown in FIG. 2.

At dawn, or at a sufficiently high ambient light level, in step V, all light sources 44 will be turned off. In step VI all of the solenoids 40 will be energized to retract the cores 42 to clear the paths of rotation of the disks 20′. If the magnetization of the cores 36 has not been changed, the partially rotated disks 20′ will automatically turn in the remaining 90° of their rotational path to assume the vertical forward display by ambient reflected light of the characters previously displayed all night by transmitted light. Alternatively, as stated in step VII, other selected disks, 20′ can be turned to full front light reflective display position, while the remaining disks 20 are turned by energizing the magnets 33, to the forward facing non-reflective upright position.

If it is desired to economize on use of power, only those lamps 44 required for transmitting the back light through open compartments can be turned on at the same time at step IV, when the selected disks 20′ are turned to the horizontal position. To further conserve electric power, the coils 34 and the solenoids 40 can remain deenergized except when they are required to change the magnetic polarity of the cores 32 and to retreat or extend the movable magnetic cores 42. The design of such external circuit is conventional so that a detailed circuit need not be described here.

It should be understood that the foregoing relates to only a preferred embodiment of the invention which has been shown by way of example only, and that it is intended to cover all the changes and modifications of the example of the invention herein chosen for the purpose of the disclosure, which do not constitute departures from the spirit and scope of the invention.

What is claimed is:

1. A matrix display system for graphic characters comprising:

a vertical panel having a multiplicity of openings arranged in a closely spaced array to visibly display a graphic character at each of said openings;

a multiplicity of display disks each having a light reflective display side, and a non-reflective opposite side to provide a light blocking background for one of said characters;

pivot means rotatably mounting said disks at said openings respectively;

first electromagnetic means adjacent said openings and behind said panel, and arranged to turn all of said disks simultaneously to an upright non-reflective forward facing first position, and further arranged to turn selected ones of said disks through paths of approximately 180° to an upright reflective forward facing second postion for displaying said characters by reflected light;

second electromagnetic means adjacent each of said disks, each of said second electromagnetic means having a stop member extensible electromagnetically into said path of the respective disk to limit turning thereof to a midway 90° horizontal position, at midway points in said paths, where said openings are substantially cleared by said disks, said stop members being retractable from said paths; and light sources disposed behind said panel, each of said light sources being aligned with one of said openings for transmitting light from said light sources through said cleared openings; whereby all of said cleared openings collectively define a graphic pattern rendered visible by said light transmitted from said light sources through said cleared openings when selected ones of said first electromagnetic means are energized to turn said selected ones of said disks in said paths to said midway positions, and whereby all others of said disks remain in said first upright position to provide a nonreflective and non-transmissive light blocking background for said visible pattern.

2. A matrix display system as defined in claim 1, wherein said openings in said panel are all of equal size, and wherein all of said disks are substantially of the same size as that of said openings, so that said transmitted light from said light sources is effectively blocked when said disks are disposed in said upright first position.

3. A matrix display system as defined in claim 1, wherein said stop members hold said selected disks in said midway positions against turning to said upright reflective second positions, so that upon retraction of said stop members all of said disks in said midway positions automatically turn to said upright light reflective second position to display said pattern by reflected ambient light.

4. A matrix display as defined in claim 1, further comprising light modifying sheets disposed between said light sources and said panel openings to modify the light transmitted from said light sources through said openings.

5. A matrix display system as defined in claim 1, wherein said openings in said panel are all circular and of substantially equal size, and wherein all of said disks are circular and of substantially the same size as that of said openings in said panel, so that said transmitted light from said light sources is effectively blocked when said disks are disposed in said upright first position.

6. A matrix display system as defined in claim 5, wherein said pivot means are pins extending from said disks at diametrally spaced horizontally aligned points, so that said disks turn on horizontal axes between said first and second positions, and are maintained horizontally in said midway positions.

7. A matrix display system as defined in claim 6, wherein said stop members hold said selected disks in said midway positions against turning to said upright reflective second positions, so that upon retraction of said stop members all of said disks in said midway positions automatically turn to said upright light reflective second position to display said pattern by reflected ambient light.

8. A matrix display system as defined in claim 7, wherein said array of openings in said panel is substantially rectangular and arranged in vertical columns and horizontal rows, for displaying said graphic characters with optimum legibility.

* * * * *